US009309710B2

(12) United States Patent
Goodman et al.

(10) Patent No.: US 9,309,710 B2
(45) Date of Patent: Apr. 12, 2016

(54) AUTOMATIC DRIVE SYSTEMS, MOVABLE PARTITION SYSTEMS INCLUDING SUCH AUTOMATIC DRIVE SYSTEMS, AND RELATED METHODS

(71) Applicant: Won-Door Corporation, Salt Lake City, UT (US)

(72) Inventors: E. Carl Goodman, Bountiful, UT (US); Michael D. George, Kaysville, UT (US); W. Michael Coleman, Salt Lake City, UT (US)

(73) Assignee: WON-DOOR CORPORATION, Salt Lake City, UT (US)

( * ) Notice: Subject to any disclaimer, the term of this patent is extended or adjusted under 35 U.S.C. 154(b) by 290 days.

(21) Appl. No.: 13/763,500

(22) Filed: Feb. 8, 2013

(65) Prior Publication Data

US 2014/0224433 A1 Aug. 14, 2014

(51) Int. Cl.

| | |
|---|---|
| ***E05D 15/26*** | (2006.01) |
| ***E05D 15/06*** | (2006.01) |
| ***E05D 15/12*** | (2006.01) |
| ***E05F 15/51*** | (2015.01) |
| ***E05F 15/632*** | (2015.01) |

(52) U.S. Cl.

CPC ..... *E05D 15/06* (2013.01); *E05D 15/12* (2013.01); *E05D 15/26* (2013.01); *E05F 15/51* (2015.01); *E05F 15/632* (2015.01); *E05Y 2400/40* (2013.01); *E05Y 2600/46* (2013.01); *E05Y 2900/142* (2013.01)

(58) Field of Classification Search

CPC ..... E06B 3/481; E06B 9/06; E06B 9/262; E05D 15/12; E05D 15/0626; E05D 15/00; E05D 15/26; E05F 15/103; E05F 15/18; E05F 15/605

USPC ..... 160/1, 7, 127, 188, 199, 196.1, 201, 160/206, 229.1, 84.02, 84.08

See application file for complete search history.

(56) References Cited

U.S. PATENT DOCUMENTS

| | | | | |
|---|---|---|---|---|
| 3,289,741 | A | 12/1966 | Gossling | |
| 3,316,624 | A | 5/1967 | Brudevold | |
| 3,807,480 | A * | 4/1974 | Smart | 160/1 |
| 4,133,364 | A | 1/1979 | Smart | |
| 6,662,848 | B2 | 12/2003 | Goodman et al. | |
| 6,757,589 | B1 * | 6/2004 | Parker et al. | 700/282 |
| 7,066,297 | B2 | 6/2006 | Goodman et al. | |
| 7,478,663 | B2 | 1/2009 | Goodman et al. | |
| 7,513,293 | B2 | 4/2009 | Goodman et al. | |
| 7,656,129 | B2 * | 2/2010 | Banta et al. | 320/141 |
| 7,740,046 | B2 | 6/2010 | Goodman et al. | |

(Continued)

*Primary Examiner* — Syed A Islam
*Assistant Examiner* — Jeremy Ramsey
(74) *Attorney, Agent, or Firm* — TraskBritt

(57) ABSTRACT

Automatic drive systems for movable partitions may comprise a floating jamb configured to attach to panels of a movable partition and glide within a pocket. A motor may be configured to extend the movable partition. The motor may be configured for mounting in the pocket on a back side of the floating jamb opposing a front side of the floating jamb to which the panels of the movable partition are configured to attach. An electronics enclosure may be sized and configured to contain electronics to connect to the motor. The electronics enclosure may be configured for positioning in the pocket on the backside in a location offset from a location where the motor is configured to be positioned. A depth of the electronics enclosure, as measured in a direction in which the floating jamb is mounted to glide, may be less than or equal to a depth of the motor.

18 Claims, 5 Drawing Sheets

(56) References Cited

U.S. PATENT DOCUMENTS

| | | | | |
|---|---|---|---|---|
| 7,845,385 | B2 | 12/2010 | Goodman et al. | |
| 8,100,164 | B2 | 1/2012 | Goodman et al. | |
| 8,365,796 | B2 | 2/2013 | Coleman et al. | |
| 2003/0155081 | A1* | 8/2003 | Goodman et al. | 160/84.02 |
| 2006/0144529 | A1 | 7/2006 | Hemphill | |
| 2011/0036016 | A1 | 2/2011 | Knight et al. | |
| 2011/0036513 | A1* | 2/2011 | Banta et al. | 160/127 |
| 2012/0012259 | A1 | 1/2012 | Goodman | |
| 2013/0020033 | A1 | 1/2013 | Saccomanno | |
| 2013/0020036 | A1 | 1/2013 | Stewart | |

* cited by examiner

AUTOMATIC DRIVE SYSTEMS, MOVABLE PARTITION SYSTEMS INCLUDING SUCH AUTOMATIC DRIVE SYSTEMS, AND RELATED METHODS

CROSS-REFERENCE TO RELATED APPLICATION

The subject matter of this application is related to the subject matter of U.S. patent application. Ser. No. 12/838,235, filed Jul. 16, 2010, now U.S. Pat. No. 8,443,866, issued May 21, 2013, for "METHODS, APPARATUSES, AND SYSTEMS FOR MOVABLE PARTITIONS," the disclosure of which is incorporated herein in its entirety by this reference.

FIELD

The disclosure relates generally to movable partitions for subdividing spaces, which may act, for example, as sound barriers, fire barriers, security barriers, or a combination of one or more of the foregoing. More specifically, disclosed embodiments relate to automatic drive systems for movable partitions that may enable easier access for service and repairs and may enable prefabrication of a greater proportion of the automatic drive system, which may result in easier quality control during fabrication and facilitate positioning and connection of drive system components during installation.

BACKGROUND

Movable partitions are used in numerous situations and environments for a variety of purposes. Such partitions may include, for example, foldable or collapsible doors configured to enclose or subdivide a room or other area. Often such partitions are utilized simply to subdivide a single large room within a building into multiple smaller rooms. The subdivision of a larger space may be desired, for example, to accommodate multiple groups or meetings simultaneously. Such partitions also may be used for noise control depending, for example, on the activities taking place in a given room or portion thereof.

Movable partitions may also be used to provide a security barrier, a fire barrier, or both a security barrier and a fire barrier. In such cases, the movable partition may be configured to automatically close upon the occurrence of a predetermined event, such as the actuation of an associated alarm. For example, one or more accordion- or similar folding-type partitions may be used as a security barrier, a fire barrier, or both a security barrier and a fire barrier, wherein each partition includes a plurality of panels connected to one another directly or with hinges. The panel connections enable the partition to fold and collapse into a compact unit for purposes of storage when not deployed. The partition may be stored in a pocket formed in the wall of a building when in a retracted or folded state. When the partition is deployed to subdivide a single large room into multiple smaller rooms, to secure an area during a fire, or for any other specified reason, the partition may be extended along a track, which may be an overhead track located above the movable partition on or in a header assembly, until the partition extends a desired distance across the room. When deployed, a leading end of the movable partition, which may include or be defined by a lead post, may complementarily engage another structure, such as a wall, a striker, or a lead post of another door.

Automatic extension and retraction of the movable partition may be accomplished using a motor located in the pocket formed in the wall of the building in which the movable partition is stored when in a retracted or folded state. The motor, which remains fixed in place within the pocket, may be used to drive extension and retraction of the movable partition.

BRIEF SUMMARY

In some embodiments, an automatic drive system for movable partitions may comprise a floating jamb configured to attach to panels of a movable partition and to glide within a pocket. A motor may be configured to extend the movable partition when operably coupled thereto. The motor may be configured for mounting in the pocket on a back side of the floating jamb opposing a front side of the floating jamb to which the panels of the movable partition are configured to attach. An electronics enclosure may be sized and configured to contain electronics to connect to the motor. The electronics enclosure may be configured for positioning in the pocket on the back side in a location offset from a location where the motor is configured to be positioned. A depth of the electronics enclosure, as measured in a direction in which the floating jamb is configured to glide, may be less than or equal to a depth of the motor.

In other embodiments, a movable partition system may comprise a movable partition comprising a sheet of interconnected panels configured to extend for subdividing a space and to retract for storing in a pocket. A floating jamb may be attached to the sheet of interconnected panels, the floating jamb being configured to glide within the pocket responsive to extension and retraction of the movable partition. A motor may be configured and operably coupled to extend the movable partition, the motor being mounted in the pocket on a back side of the floating jamb opposing a front side of the floating jamb on which the sheet of interconnected panels is positioned. An electronics enclosure may be sized and configured to contain electronics to connect to the motor, the electronics enclosure being configured for positioning in the pocket on the back side in a location offset from a location where the motor is configured to be positioned. A depth of the electronics enclosure, as measured in a direction in which the floating jamb is configured to glide, may be less than or equal to a depth of the motor.

In still other embodiments, methods of installing automatic drive systems for movable partitions may comprise supporting a movable partition comprising a sheet of interconnected panels. A floating jamb may be positioned within a pocket configured to store at least a portion of the movable partition when in a retracted state and the floating jamb may be attached to the sheet of interconnected panels. A motor configured and operably coupled to extend the movable partition to an extended state may be mounted in the pocket on a back side of the floating jamb opposing a front side of the floating jamb on which the sheet of interconnected panels is located within the pocket. An electronics enclosure configured to contain electronics to connect to the motor may be positioned in the pocket offset from the motor. A depth of the electronics enclosure, as measured in a direction in which the floating jamb is mounted to glide, may be less than or equal to a depth of the motor.

BRIEF DESCRIPTION OF THE DRAWINGS

While the disclosure concludes with claims particularly pointing out and distinctly claiming embodiments within the scope of the disclosure, various features and advantages of embodiments encompassed by the disclosure may be more readily ascertained from the following description when read in conjunction with the accompanying drawings, in which:

DETAILED DESCRIPTION

The illustrations presented herein are not meant to be actual views of any particular movable partition system, automatic drive system, or component thereof, but are merely idealized representations employed to describe illustrative embodiments. Thus, the drawings are not necessarily to scale. Additionally, elements common between figures may retain the same or similar numerical designation.

Disclosed embodiments relate generally to automatic drive systems for movable partitions that may enable easier access for service and repairs and may enable prefabrication of a greater proportion of the automatic drive system, which may result in easier quality control during fabrication and facilitate positioning and connection of drive system components during installation. More specifically, disclosed are embodiments of an electronics enclosure that may be located within a pocket configured to store a movable partition, which electronics enclosure may maintain (i.e., not increase) or decrease the required depth of the pocket, may contain electronics for powering and controlling a motor to automatically operate the movable partition, may be prefabricated for quick and easy installation, and may be positioned for easy access after installation.

Figure 1:
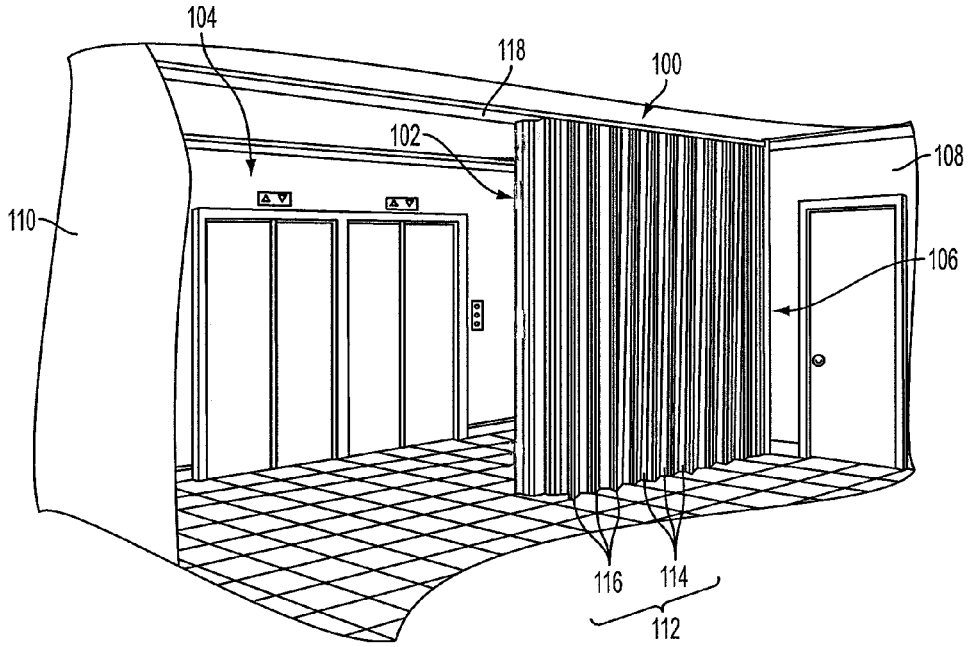
FIG. 1 is a perspective view of a movable partition system.

Referring to FIG. 1, a perspective view of a movable partition system 100 is shown. The movable partition system 100 may include a movable partition 102 configured to subdivide a space 104 (e.g., a room, a hall, or another interior portion of a building). For example, the movable partition 102 may be stored in a pocket 106 in a wall 108 when in a retracted state and may be extended across the space 104 to an extended state to subdivide the space 104. The movable partition 102 may extend to an opposing wall 110 when in the extended state in some embodiments. In other embodiments, the movable partition 102 may be connected to another movable partition when in the extended state (e.g., in a bi-part configuration). The movable partition 102 may comprise at least one sheet 112 of interconnected panels 114 configured to fold relative to one another when transitioning from the retracted state to the extended state and vice versa. For example, the panels 114 may be connected to one another by hinges 116, which may enable the sheet 112 to extend and retract in an accordion-like manner. The hinges 116 may comprise components separate from or integral to the panels 114. A lead post 124 (see FIG. 2) of the movable partition 102 may be suspended, for example, by a trolley 156 (see FIG. 3) and panels 114 of the movable partition 102 may be suspended, for example, by panel rollers 157 (see FIG. 3) engaged with an overhead track 118. As the movable partition 102 is extended and retracted, the trolley 156 (see FIG. 3) and panel rollers 157 (see FIG. 3) may roll within the track 118 to directionally guide the movable partition 102. When in the extended state, the movable partition 102 may act as a fire barrier, a security barrier, a heat transfer barrier, a sound barrier, may act as more than one of the foregoing, or may act simply as a divider for convenience in using the space 104.

Figure 2:
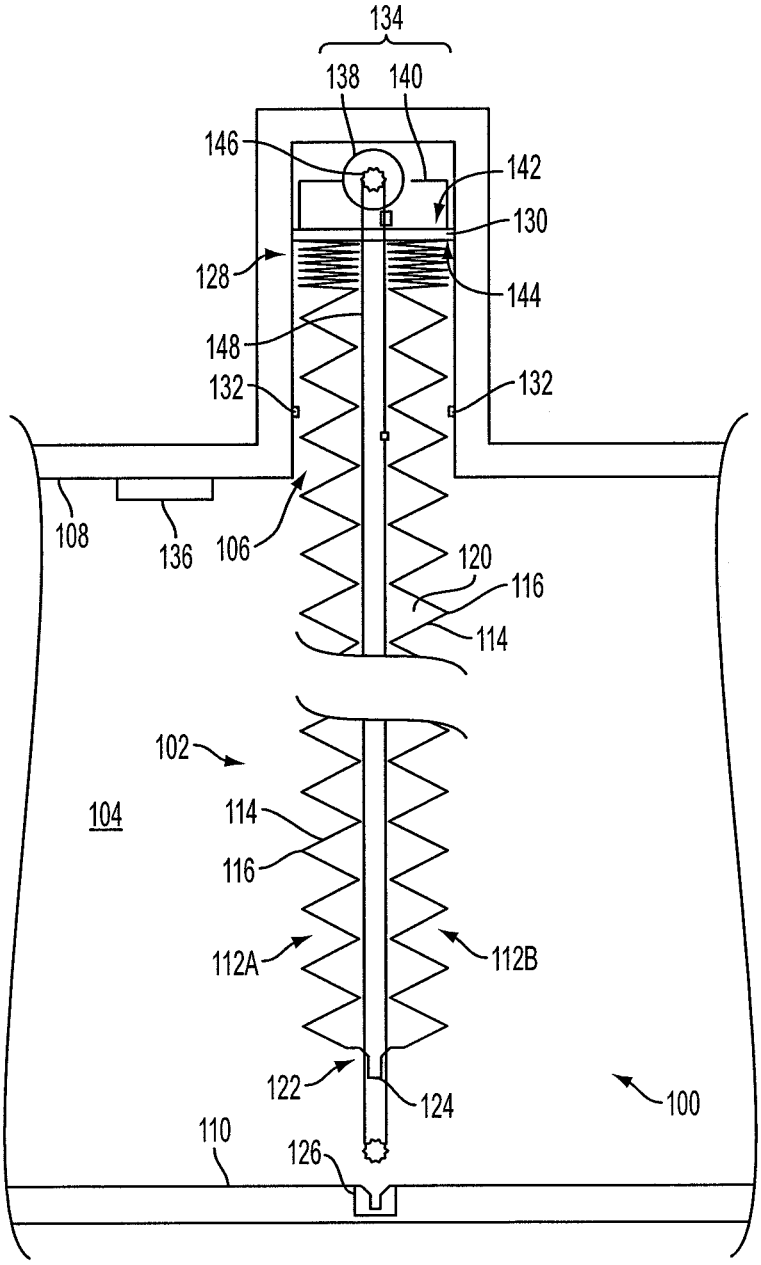
FIG. 2 is a cross-sectional overhead view of the movable partition system of FIG. 1.

With reference to FIG. 2, a cross-sectional overhead view of the movable partition system 100 of FIG. 1 is shown. In some embodiments, such as that shown in FIG. 2, the movable partition 102 may comprise two sheets 112A and 112B of interconnected panels 114 connected at their distal ends and laterally spaced from one another to define an interior space 120 within the movable partition 102. At a leading end 122 of the movable partition 102, the sheets 112A and 112B may be connected to a lead post 124 configured to engage with a striker 126 in the opposing wall 110 or with a mating lead post of another movable partition when in the extended state. At an opposing, trailing end 128 of the movable partition 102, the sheets 112A and 112B may be connected to a floating jamb 130. The floating jamb 130 may be located in the pocket 106, and may be mounted to glide freely in the pocket 106 responsive to extension and retraction of the movable partition 102. For example, the floating jamb 130 may be supported on jamb rollers 154 (see FIG. 3) in the track 118 (see FIG. 3), which may enable the floating jamb 130 to move in the pocket 106. Jamb stops 132 may be configured and located to limit movement of the floating jamb 130 such that the floating jamb 130 does not unintentionally exit the pocket 106 when the movable partition 102 is extended. The jamb stops 132 may also be configured to permit a user to slide the floating jamb 130 beyond the jamb stops 132 to access the pocket 106 and components disposed in the pocket 106.

The movable partition 102 may be configured to automatically move between the retracted and extended states. For example, the movable partition system 100 may include an automatic drive system 134 configured to automatically extend and retract the movable partition 102. In some embodiments, the automatic drive system 134 may be configured to extend and retract the movable partition 102 responsive to actuation of an associated alarm (e.g., a fire alarm or a security alarm), to user input from a control panel 136, which may be located in the same space 104 as the movable partition 102 or in a remote space (e.g., a control room or security station), or to both actuation of an alarm and user input. The automatic drive system 134 may include a motor 138 and an electronics enclosure 140 located in the pocket 106. The motor 138 and the electronics enclosure 140 may be positioned on a back side 142 of the floating jamb 130 opposing a front side 144 of the floating jamb 130 on which the movable partition 102 is located. The motor 138 may include a rotatable drive member 146 (e.g., a gear or a drive wheel), which may be engaged with a driving transfer mechanism 148 (e.g., a chain or a belt). The driving transfer mechanism 148 may, in turn, be connected to the trolley 156 (see FIG. 3) such that actuation of the motor 138, and corresponding rotation of the rotatable drive member 146, causes the driving transfer mechanism 148 to move the trolley 156 (see FIG. 3) along the track 118. The electronics enclosure 140 may be configured to support electronics 172 (see FIG. 5) for controlling, powering, or controlling and powering the motor 138.

Figure 3:
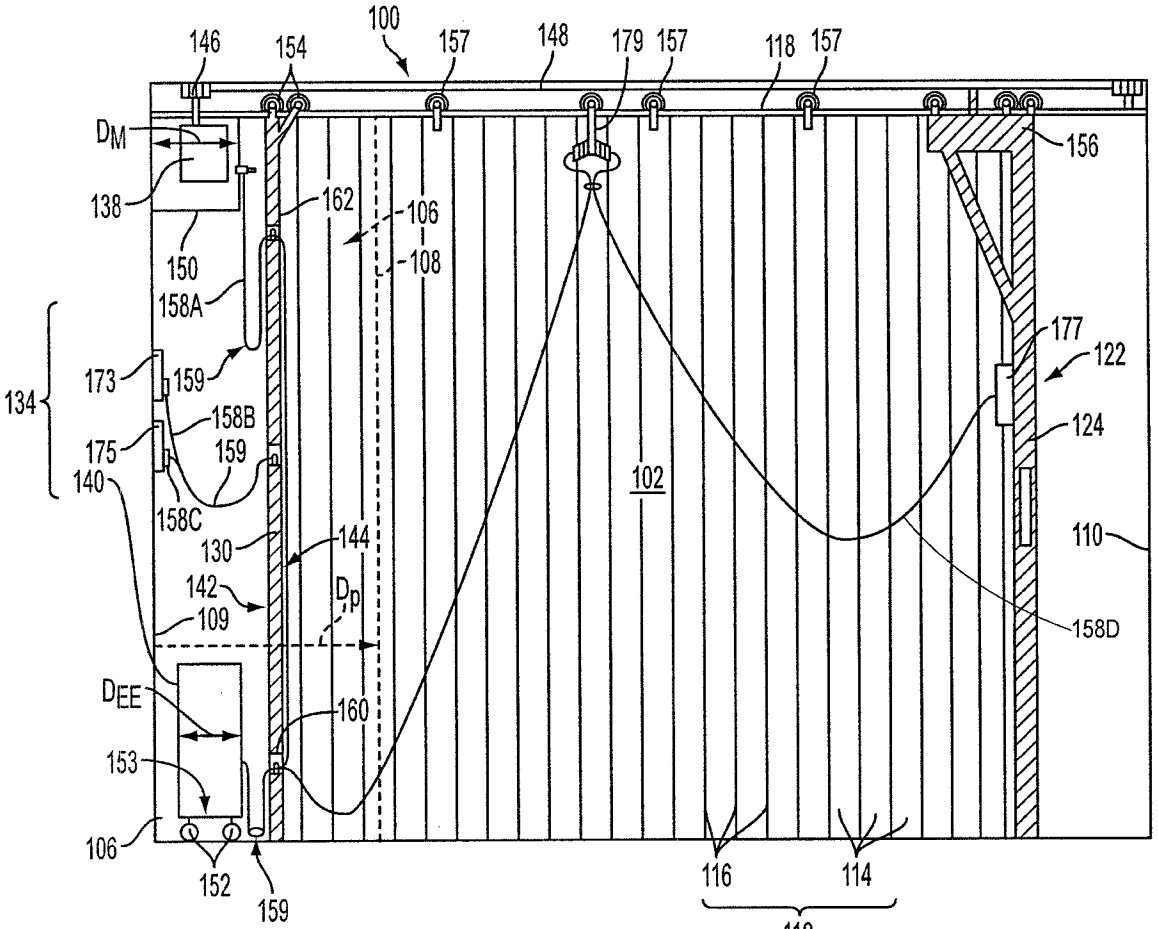
FIG. 3 is a cross-sectional side view of the movable partition system of FIG. 1.

Referring to FIG. 3, a cross-sectional side view of the movable partition system 100 of FIG. 1 is shown. A depth $D_{EE}$ of the electronics enclosure 140, as measured in a direction in which the floating jamb 130 moves during extension and retraction of the movable partition 102, may be less than or equal to a depth $D_M$ of the motor 138. When referring to the depth $D_M$ of the motor 138, what is meant may depend on the particular configuration used for mounting the motor 138 in the pocket 106. For example, the depth $D_M$ of the motor 138 may include only dimensions of the motor 138 itself in embodiments where the motor 138 is mounted directly to one or more walls defining the pocket 106. In embodiments where the motor 138 is supported within a motor enclosure 150 mounted to walls defining the pocket 106 (or other mounting hardware that may increase the depth $D_M$ in the pocket 106), the depth $D_M$ of the motor 138 may include the dimensions of the motor enclosure 150. For example, the depth $D_{EE}$ of the electronics enclosure 140 may be between about 2 inches (5.08 cm) and about 16 inches (40.64 cm), which may be less than or equal to the depth $D_M$ of the motor 138, and any corresponding motor enclosure 150. More specifically, the depth $D_{EE}$ of the electronics enclosure 140 may be between about 6 inches (15.24 cm) and about 10 inches (25.4 cm), which may be less than or equal to the depth $D_M$ of the motor 138, and any corresponding motor enclosure 150.

In addition, the motor 138 may be mounted in a location offset from a location where the electronics enclosure 140 is positioned. For example, the electronics enclosure 140 may be vertically offset (e.g., above or below) from the motor 138. As another example, the electronics enclosure 140 may be laterally offset (e.g., to the left or right when facing the pocket 106) from the motor 138. As a specific, non-limiting example, the electronics enclosure 140 may be positioned underneath the motor 138, and may not protrude beyond the motor 138, when the movable partition 102 is fully retracted for storage in the pocket 106. Thus, when the movable partition 102 is in the retracted state, the electronics enclosure 140 may nest with (e.g., under, above, beside) the motor 138. For example, the back side 142 of the floating jamb 130 may abut against the motor 138, as opposed to there being a space required between the floating jamb 130 and the motor 138 due to the depth $D_{EE}$ of the electronics enclosure 140, when the movable partition 102 is fully retracted. Due to the comparative depths $D_{EE}$ and $D_M$ of the electronics enclosure 140 and the motor 138 and their offset positioning, the electronics enclosure 140 may not increase (e.g., may maintain or decrease) the required depth of the pocket 106 to contain (e.g., entirely conceal) the automatic drive system 134 and the movable partition 102 when the movable partition 102 is in the retracted state.

Like the floating jamb 130, the electronics enclosure 140 may be configured to move freely in the pocket 106. For example, the electronics enclosure 140 may include rollers 152 (e.g., wheels or casters) on a bottom 153 of the electronics enclosure 140 to enable the electronics enclosure 140 to roll on a horizontal support surface (e.g., floor) within the pocket 106. As another example, the electronics enclosure 140 may be supported from rollers engaged with the track 118, in a manner similar to the jamb rollers 154 supporting the floating jamb 130 and the trolley 156 supporting the movable partition 102. As yet another example, an electronics enclosure 140' (see FIG. 4) may be attached to the back side 142 of the floating jamb 130, such as, for example, in the manner shown in FIGS. 4 and 5, and may move with the floating jamb 130.

The motor 138 may be connected to electronics 172 (see FIG. 5) within the electronics enclosure 140 by wiring 158A, and the electronics 172 may be connected to a power source 173, a separate control system (e.g., associated with the control panel 136 (see FIG. 2)), or both by wiring 158B and 158C, to enable the electronics 172 (see FIG. 5) to control, power, or control and power the motor 138. For example, wiring 158A connecting the motor 138 to the electronics 172 may extend from the motor 138, past the floating jamb 130 to the front side 144, back through an opening 160 in the floating jamb 130 to the back side 142, to the electronics 172 (see FIG. 5). In some embodiments, the wiring 158A may extend from the motor 138, directly over the floating jamb 130 to the front side 144, back through the opening 160 in the floating jamb 130 to the back side 142, directly to the electronics 172 (see FIG. 5). In other embodiments, the wiring 158A may extend from the motor 138, through a wall of the motor enclosure 150, through another opening 162 in the floating jamb 130 to the front side 144, back through the opening 160 to the back side 142, through a wall of the electronics enclosure 140, to the electronics 172 (see FIG. 5). As another example, the wiring 158A may extend from the motor 138, to the floating jamb 130 on the back side 142, down the back side 142, to the electronics 172 (see FIG. 5). As yet another example, the wiring 158A may extend from the motor 138 directly to the electronics 172 without contacting the floating jamb 130. Any time the wiring 158A passes through an opening 160 or 162, past a barrier (e.g., the motor enclosure 150, the floating jamb 130, or the electronics enclosure 140), or along a surface (e.g., along the back side 142 of the floating jamb 130), the wiring 158A may be secured to the structure defining the opening 160 or 162, the barrier, or the surface (e.g., using zip ties or junction boxes) to reduce the likelihood that the wiring 158A will slip and potentially get caught, break, or otherwise experience wear or force that might lead to failure.

The wiring 158A may comprise, for example, a first set of wires providing power to the motor 138 and a second set of wires communicating control signals to the motor 138. As a specific, non-limiting example, the wiring 158A may comprise a first set of wires located within corrugated conduit configured to provide power to the motor 138 and a second set of wires located outside the corrugated conduit configured to communicate control signals (e.g., to extend, retract, stop, etc. the movable partition 102) to the motor 138. Placing some wires within corrugated conduit and others outside the corrugated conduit may electrically isolate high-powered wiring from low-powered wiring. In addition, wiring 158B and 158C connecting the electronics 172 to a power source 173, a separate control system, or both located within the pocket 106 may comprise, for example, a first set of wiring 158B extending from a power source 173 to the electronics 172 and a second set of wiring 158C extending from a system relay 175 to the electronics 172. More specifically, the wiring 158B may comprise a first set of wires located within corrugated conduit connected to a power source 173 comprising a junction box providing utility A/C power configured to provide power to the electronics 172 and the wiring 158C may comprise a second set of wires located outside the corrugated conduit connected to a system relay 175 configured to communicate control signals (e.g., indicating actuation of an alarm, user input from a control panel 136, status polling from a central control system, etc.). Placing some wires within corrugated conduit and others outside the corrugated conduit may electrically isolate high-powered wiring from low-powered wiring. The wiring 158B and 158C connecting the electronics 172 to a power source 173, a system relay 175, or both may be routed along any of the paths described previously in connection with the wiring 158A connecting the motor 138 to the electronics 172.

The wiring 158A, 158B, and 158C may comprise slack 159 between the motor 138 and the floating jamb 130, between the power source 173 and the floating jamb 130, between the system relay 175 and the floating jamb 130, between the floating jamb 130 and the electronics enclosure 140, between the motor 138 and the electronics enclosure 140, between the power source 173 and the electronics enclosure 140, between the system relay 175 and the electronics enclosure 140, or any combination of these. For example, portions of the wiring 158A, 158B, and 158C may be secured to the motor 138, the power source 173, the system relay 175, the floating jamb 130, and the electronics enclosure 140 leaving excess portions of the wiring 158A, 158B, and 158C beyond a minimum length of the wiring 158A, 158B, and 158C required to connect the motor 138, the power source 173, the system relay 175, and the electronics enclosure 140 as slack 159 between such components.

Lengths of the wiring 158A, 158B, and 158C may be sufficiently long to enable a user to remove the floating jamb 130 from within the pocket 106 and access the motor 138, the electronics enclosure 140, and other components within the pocket 106 without disconnecting the wiring 158A, 158B, and 158C from the motor 138, the power source 173, the system relay 175, and the electronics enclosure 140. For example, the depth $D_M$ of the motor 138 or the depth $D_{EE}$ of the electronics enclosure 140 combined with the length of the wiring 158A connecting the motor 138 to the electronics 172, as measured in a direction of movement of the movable partition 102 (i.e., excluding the vertical distance along which the wiring 158A may extend), may be greater than the depth $D_P$ of the pocket 106 as measured from a back wall 109 of the pocket 106 to the wall 108 at an opening of the pocket 106. More specifically, the length of the wiring 158A connecting the motor 138 to the electronics 172 (FIG. 5) may enable the electronics enclosure 140 to be moved at least about 6 inches (15.24 cm), about 24 inches (60.96 cm), about 30 inches (76.2 cm), about 48 inches (121.92 cm), or even greater beyond the wall 108 at the opening of the pocket 106 without disconnecting the wiring 158A. Likewise, the length of each of the sets of wiring 158B and 158C connecting the power source 173 and the system relay 175 to the electronics 172, as measured in the direction of movement of the movable partition 102 (i.e., excluding the vertical distance along which the wiring 158B and 158C may extend) may be, for example, greater than the depth $D_P$ of the pocket 106 as measured from the back wall 109 of the pocket 106 to the wall 108 at the opening of the pocket 106. More specifically, the length of each of the sets of wiring 158B and 158C connecting the power source 173 and the system relay 175 to the electronics 172 may enable the electronics enclosure 140 to be moved at least about 6 inches (15.24 cm), about 24 inches (60.96 cm), about 30 inches (76.2 cm), about 48 inches (121.92 cm), or even greater beyond the wall 108 at the opening of the pocket 106 without disconnecting the wiring 158B and 158C. In this way, a user may pull the floating jamb 130 out of the pocket 106, pull the electronics enclosure 140 out of the pocket 106, and access the electronics enclosure 140 and electronics 172 (see FIG. 5) for servicing and maintenance without disconnecting the wiring 158A, 158B, and 158C and without being forced to work in tight, cramped spaces (e.g., within the pocket 106 itself).

Wiring 158D may also be provided to connect the electronics 172 (see FIG. 5) to electronic components not located within the pocket 106. For example, wiring 158D may extend from a multiplexer 177 (mux) located proximate (e.g., attached to) the lead post 124 of the movable partition 102 to the electronics 172. The mux 177 may receive input from any of several sources (e.g., an emergency push bar to temporarily open the movable partition 102, temperature sensors to indicate the presence or intensity of a fire on either side of the movable partition 102, a control switch to test extension and retraction of the movable partition 102) and send a signal indicative of the input to the electronics 172. As a specific, non-limiting example, the wiring 158D may extend from the mux 177, through at least one wire support 179 configured to support the wiring 158D, embodiments of which are disclosed in more detail in U.S. patent application Ser. No. 13/185,325, filed Jul. 18, 2011, now U.S. Pat. No. 8,567,472, issued Oct. 19, 2013, and titled "WIRE TROLLEYS, MOVABLE PARTITION SYSTEMS INCLUDING SUCH WIRE TROLLEYS, AND RELATED METHODS," and U.S. patent application Ser. No. 13/185,303, filed Jul. 18, 2011, now U.S. Pat. No. 8,448,687, issued May 28, 2013, and titled "WIRE SUPPORTS, MOVABLE PARTITION SYSTEMS INCLUDING SUCH WIRE SUPPORTS, AND RELATED METHODS," the disclosure of each of which is incorporated herein in its entirety by this reference, through the floating jamb 130, to the electronics 172.

Figure 4:
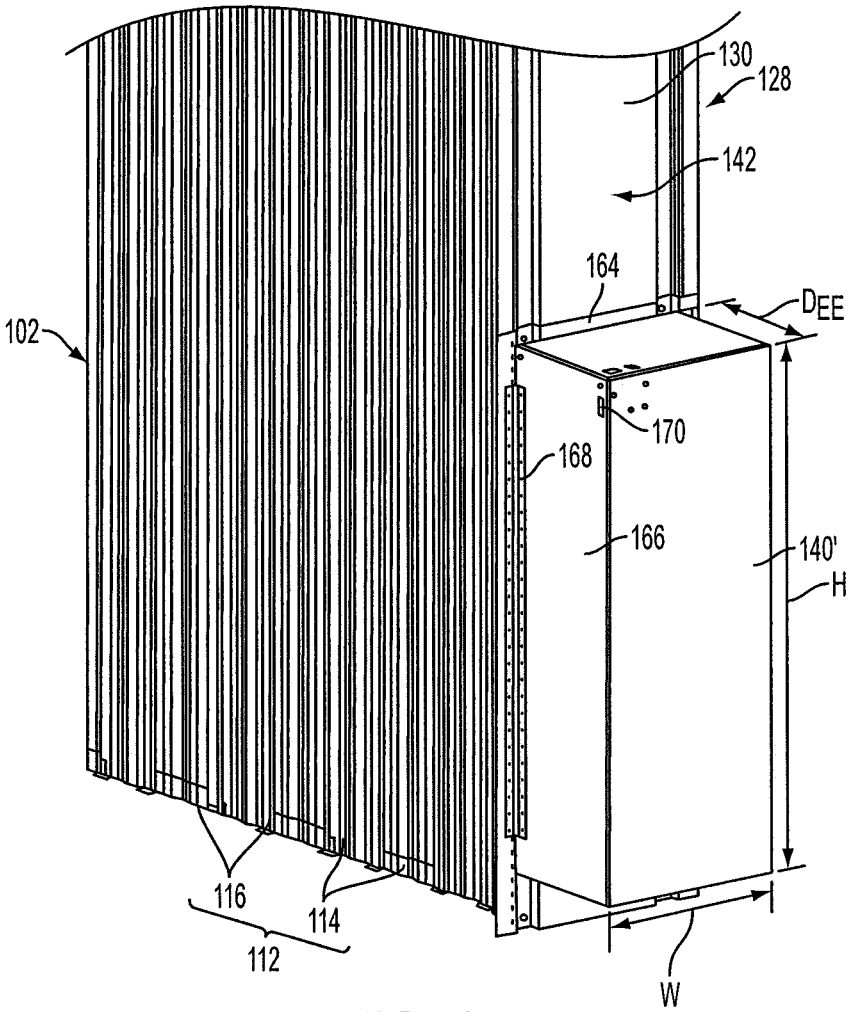
FIG. 4 is a perspective view of an electronics enclosure for use with a movable partition system.

With reference to FIG. 4, a perspective view of an electronics enclosure 140' for use with a movable partition system 100 (see FIGS. 1 through 3) is shown. The electronics enclosure 140' may comprise, for example, a generally cuboid-shaped box of sheet metal sized and configured to support electronics 172 (see FIG. 5) for controlling, powering, or controlling and powering a motor 138 (see FIGS. 1 through 3). More specifically, the electronics enclosure 140' may comprise a box having a height H of between about 24 inches (60.96 cm) and about 48 inches (121.92 cm), a width W of between about 6 inches (15.24 cm) and about 18 inches (45.72 cm), and a depth $D_{EE}$ of between about 2 inches (5.08 cm) and about 16 inches (40.64 cm). As a specific, non-limiting example, the electronics enclosure 140' may comprise a box having a height H of about 32 inches (81.28 cm), a width W of about 13 inches (33.02 cm), and a depth $D_{EE}$ of about 6 inches (15.24 cm). A connection sheet 164, which may define one wall of the electronics enclosure 140', may abut against and be secured to the back side 142 of the floating jamb 130, for example, using bolts, clips, or rivets. In some embodiments, the connection sheet 164 may extend along the back side 142 of the floating jamb 130 and be connected to and supported by the jamb rollers 154 (see FIG. 3). The electronics enclosure 140' may include an access panel 166, which may define part of, or an entirety of, another wall or walls of the electronics enclosure 140' and may enable a user to access electronics 172 (see FIG. 5) located within the electronics enclosure 140'. For example, the access panel 166 may comprise one of the panels defining the electronics enclosure 140' and may be attached to the connection sheet 164 using a hinge 168, for example a piano hinge, to enable the access panel 166 to swing open, and may include a latch 170 to secure the access panel 166 in a closed position. As another example, the access panel 166 may comprise all remaining panels defining the electronics enclosure 140' and may be attached to the connection sheet 164 using a hinge 168 on a side of the access panel 166 opposing a side on which the latch 170 is positioned. Thus, the electronics enclosure 140' may be a prefabricated unit, which may be easily installed and which may enable easy access to its contents for service and replacement after installation.

Figure 5:
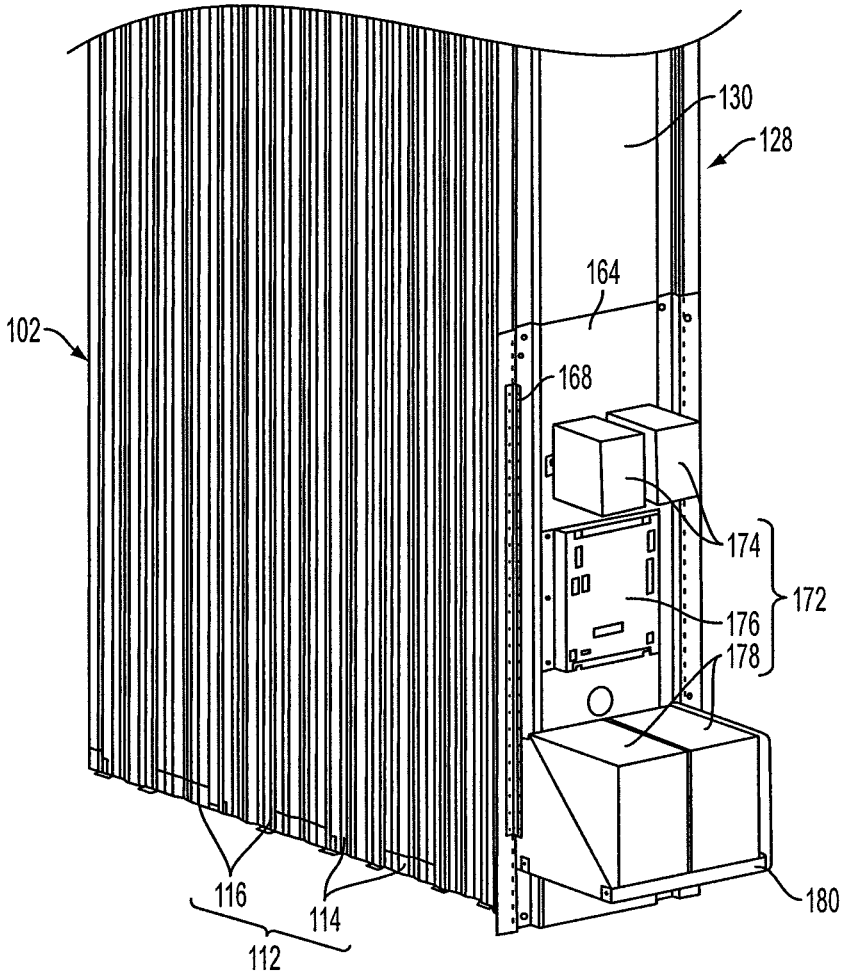
FIG. 5 is a perspective view of electronics within the electronics enclosure of FIG. 4.

Referring to FIG. 5, a perspective view of electronics 172 within the electronics enclosure 140' of FIG. 4 is shown. The electronics 172 may be configured to control, power, or control and power the motor 138 (see FIGS. 2 and 3) to extend and retract the movable partition 102. For example, the electronics 172 may comprise a power converter 174, which may be configured to convert alternating current to direct current and to reduce or amplify the quantity of electrical power to be supplied to the motor 138 (see FIGS. 2 and 3). As another example, the electronics 172 may comprise a motor controller unit 176 configured to control the motor 138 (see FIGS. 2 and 3), which may include ports and processors for receiving and interpreting signals, such as, for example, signals indicating alarm actuation or user inputs, and for sending signals, such as, for example, to initiate power to the motor 138 (see FIGS.

2 and 3). As yet another example, the electronics 172 may comprise a battery 178, which may provide backup electrical power in the event that other power sources fail (e.g., during a blackout). These electronics 172 are to be taken as illustrative and not limiting; the actual electronics 172 employed may omit one or more of these specific items and may include additional items not mentioned here. In some embodiments, at least some of the electronics 172 may be supported by shelving 180 within the electronics enclosure 140' (see FIG. 4). For example, the battery 178 may be placed on shelving 180 comprising lips defining receptacles configured to receive the battery 178. Similar shelving may be used to support the power converter 174 and the motor controller unit 176 within the electronics enclosure 140' in some embodiments. As additional examples, the electronics 172 may include a voltage calibrator configured to adjust (e.g., to step up or to step down) the voltage of incoming power, one or more switches (e.g., to test operation of the door), one or more circuit breakers, one or more fuses, or any combination of these. In some embodiments, components of the electronics 172 may be combined on a single circuit board (e.g., an interconnect board) or boards.

With combined reference to FIGS. 1 through 3, the movable partition 102 may be supported from the track 118 when installing the movable partition system 100. The sheets 112A and 112B of the movable partition 102 may be positioned on the front side 144 of the floating jamb 130 to which they are attached. The motor 138, and any accompanying motor enclosure 150, may be mounted within the pocket 106. For example, the motor 138 may be mounted at an upper portion of the pocket 106 proximate the track 118. The electronics enclosure 140 or 140' (see FIG. 4) may be positioned in the pocket 106 offset from the motor 138. For example, the electronics enclosure 140 may be placed on its rollers 152 beneath the motor 138. As another example, the electronics enclosure 140' may be attached to or be an integral component of the floating jamb 130 at a lower portion thereof, and may be nested below the motor 138 as the floating jamb 130 is positioned in the pocket 106 and supported from the track 118. In some embodiments, an installer may support electronics 172 (see FIG. 5) within the electronics enclosure 140 or 140', which may involve setting the electronics 172 into prefabricated receptacles for the electronics 172, attaching the electronics 172 to walls of the electronics enclosure 140 or 140' (e.g., using screws, bolts, rivets, or clips), or a combination of these techniques. In other embodiments, the electronics 172 may already be installed in the electronics enclosure 140 or 140' during fabrication at a location away from the installation site. Wiring 158A, 158B, and 158C may be connected to the motor 138, the power source 173, and the system relay 175, respectively, extended past the floating jamb 130 to the front side 144, inserted through the opening 160 in the floating jamb 130 to the back side 142, and connected to the electronics 172 within the electronics enclosure 140 or 140'. In some embodiments, the wiring 158A, 158B, and 158C may be physically secured to the motor 138, the motor enclosure 150, the power source 173, the system relay 175, the floating jamb 130, the electronics enclosure 140 or 140', the electronics 172, or any combination of these. Wiring 158D may be connected to the mux 177, suspended from one or more wire supports 179, extended past the floating jamb 130 to the back side 142, and connected to the electronics 172. The movable partition 102 may be fully retracted into the pocket 106 for storage, which may cause the back side 142 of the floating jamb 130 to abut against the motor 138 (or its associated motor enclosure 150). When the movable partition 102 is retracted, the electronics enclosure 140 or 140' may be positioned underneath the motor 138 and may not protrude beyond the motor 138 in the direction in which the floating jamb 130 is mounted to glide.

After installing the movable partition system 100, maintenance and servicing (e.g., testing and replacement) may be performed on the automatic drive system 134. For example, the floating jamb 130 may be slid past the jamb stops 132 and out of the pocket 106 to expose the electronics enclosure 140 or 140'. The access panel 166 of the electronics enclosure 140 or 140' may be opened to access the electronics 172 for such maintenance and servicing.

Additional, non-limiting embodiments within the scope of the disclosure include the following:

Embodiment 1

An automatic drive system for a movable partition may comprise a floating jamb configured to attach to panels of a movable partition and to glide within a pocket. A motor may be configured, when operably coupled to the movable partition, to extend the movable partition. The motor may be configured for mounting in the pocket on a back side of the floating jamb opposing a front side of the floating jamb to which the panels of the movable partition are configured to attach. An electronics enclosure may be sized and configured to contain electronics to connect to the motor. The electronics enclosure may be configured for positioning in the pocket on the back side of the floating jamb in a location offset from a location where the motor is configured to be positioned. A depth of the electronics enclosure, as measured in a direction in which the floating jamb is mounted to glide, may be less than or equal to a depth of the motor.

Embodiment 2

The automatic drive system of Embodiment 1, wherein the electronics enclosure is configured to be attached to or be an integral component of the floating jamb on the back side.

Embodiment 3

The automatic drive system of Embodiment 1 or Embodiment 2, wherein the electronics enclosure comprises wheels on a bottom of the electronics enclosure configured to roll freely on a horizontal support surface in the pocket.

Embodiment 4

The automatic drive system of any one of Embodiments 1 through 3, wherein the depth of the electronics enclosure is between 2 inches (5.08 cm) and 16 inches (40.64 cm).

Embodiment 5

The automatic drive system of Embodiment 4, wherein the depth of the electronics enclosure is between 6 inches (15.24 cm) and 10 inches (25.4 cm).

Embodiment 6

The automatic drive system of any one of Embodiments 1 through 5, further comprising electronics supported in the electronics enclosure, the electronics being selected from the group consisting of a power converter, a battery, a motor controller unit, a voltage calibrator, a switch, a circuit breaker, and a fuse.

Embodiment 7

The automatic drive system of Embodiment 6, wherein the motor is connected to the electronics by wiring extending from the motor, past the floating jamb to the front side, back through an opening in the floating jamb to the back side, to the electronics.

Embodiment 8

The automatic drive system of Embodiment 7, wherein a length of the wiring connecting the motor to the electronics is sufficient to enable the electronics enclosure to be moved out of the pocket without disconnecting the wiring.

Embodiment 9

The automatic drive system of Embodiment 6 or Embodiment 7, wherein the electronics are connected to at least one of a power supply and a system relay by wiring extending from the electronics, past the floating jamb to the front side thereof, back through at least one opening in the floating jamb to the back side, to the at least one of the power supply and the system relay.

Embodiment 10

The automatic drive system of Embodiment 9, wherein a length of the wiring connecting the at least one of the power supply and the system relay to the electronics is sufficient to enable the electronics enclosure to be moved out of the pocket without disconnecting the wiring.

Embodiment 11

The automatic drive system of any one of Embodiments 6 through 10, wherein the electronics enclosure comprises an access panel configured to be opened to access the electronics.

Embodiment 12

The automatic drive system of any one of Embodiments 1 through 11, wherein the electronics enclosure is configured to be positioned underneath, and not to protrude beyond a depth of, the motor when the movable partition is retracted.

Embodiment 13

A movable partition system may comprise a movable partition comprising a sheet of interconnected panels configured to extend for subdividing a space and to retract for storing in a pocket. A floating jamb may be attached to the sheet of interconnected panels, the floating jamb being configured to glide within the pocket responsive to extension and retraction of the movable partition. A motor may be configured and operably coupled to extend the movable partition, the motor being mounted in the pocket on a back side of the floating jamb opposing a front side of the floating jamb on which the sheet of interconnected panels is positioned. An electronics enclosure may be sized and configured to contain electronics to connect to the motor, the electronics enclosure being configured for positioning in the pocket on the back side in a location offset from a location where the motor is configured to be positioned. A depth of the electronics enclosure, as measured in a direction in which the floating jamb is mounted to glide, may be less than or equal to a depth of the motor.

Embodiment 14

A method of installing an automatic drive system for a movable partition may comprise supporting a movable partition comprising a sheet of interconnected panels. A floating jamb may be positioned within a pocket configured to store at least a portion of the movable partition when in a retracted state and the floating jamb may be attached to the sheet of interconnected panels. A motor configured to extend the movable partition to an extended state may be mounted in the pocket on a back side of the floating jamb opposing a front side of the floating jamb on which the sheet of interconnected panels is located within the pocket. An electronics enclosure sized and configured to contain electronics to connect to the motor may be positioned in the pocket offset from the motor. A depth of the electronics enclosure, as measured in a direction in which the floating jamb is mounted to glide, may be less than or equal to a depth of the motor.

Embodiment 15

The method of Embodiment 14, further comprising attaching the electronics enclosure to or integrating the electronics enclosure with the back side of the floating jamb.

Embodiment 16

The method of Embodiment 14 or Embodiment 15, further comprising supporting the electronics enclosure on rollers configured to roll freely on a horizontal support surface in the pocket.

Embodiment 17

The method of any one of Embodiments 14 through 16, further comprising retracting the movable partition into the retracted state and abutting the floating jamb against the motor.

Embodiment 18

The method of any one of Embodiments 14 through 17, further comprising positioning the electronics enclosure underneath the motor so that, when the movable partition is in the retracted state the electronics enclosure does not protrude beyond a depth of the motor.

Embodiment 19

The method of any one of Embodiments 14 through 18, further comprising supporting electronics in the electronics enclosure, the electronics selected from the group consisting of a power converter, a battery, a motor controller unit, a voltage calibrator, a switch, a circuit breaker, and a fuse.

Embodiment 20

The method of Embodiment 19, further comprising connecting the motor to the electronics by extending wiring from the motor, past the floating jamb to the front side, back through an opening in the floating jamb to the back side, to the electronics.

Embodiment 21

The method of Embodiment 20, further comprising selecting a length of the wiring to enable the electronics enclosure to be moved out of the pocket without disconnecting the wiring.

Embodiment 22

The method of any one of Embodiments 19 through 21, wherein the electronics enclosure comprises an access panel, and further comprising opening the access panel to access the electronics.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventors.

What is claimed is:

1. An automatic drive system for a movable partition, comprising:

a floating jamb configured to attach to panels of a movable partition and to glide within a pocket;

a motor configured, when operably coupled to the movable partition, to extend the movable partition, the motor being configured for mounting in the pocket on a back side of the floating jamb opposing a front side of the floating jamb to which the panels of the movable partition are configured to attach;

an electronics enclosure configured to contain electronics to connect to the motor, the electronics enclosure being sized and configured for positioning in the pocket on the back side of the floating jamb in a location offset from a location where the motor is configured to be positioned, wherein a depth of the electronics enclosure, as measured in a direction in which the floating jamb is mounted to glide, is less than or equal to a depth of the motor, as measured in the same direction; and electronics housed in the electronics enclosure, the electronics selected from the group consisting of a power converter, a battery, a motor controller unit, a voltage calibrator, a switch, a circuit breaker, and a fuse;

wherein the motor is connected to the electronics by wiring extending from the motor, past the floating jamb to the front side thereof, back through an opening in the floating jamb to the back side, to the electronics.

2. The automatic drive system of claim 1, wherein the electronics enclosure is configured to be attached to or is an integral component of the floating jamb on the back side.

3. The automatic drive system of claim 1, wherein the depth of the electronics enclosure is between 2 inches (5.08 cm) and 16 inches (40.64 cm).

4. The automatic drive system of claim 3, wherein the depth of the electronics enclosure is between 6 inches (15.24 cm) and 10 inches (25.4 cm).

5. The automatic drive system of claim 1, wherein a length of the wiring connecting the motor to the electronics is sufficient to enable the electronics enclosure to be moved out of the pocket without disconnecting the wiring.

6. The automatic drive system of claim 1, wherein the electronics are connected to at least one of a power supply and a system relay by wiring extending from the electronics, past the floating jamb to the front side thereof, back through at least one opening in the floating jamb to the back side, to the at least one of the power supply and the system relay.

7. The automatic drive system of claim 6, wherein a length of the wiring connecting the at least one of the power supply and the system relay to the electronics is sufficient to enable the electronics enclosure to be moved out of the pocket without disconnecting the wiring.

8. The automatic drive system of claim 1, wherein the electronics enclosure comprises an access panel configured to be opened to access the electronics.

9. The automatic drive system of claim 1, wherein the electronics enclosure is configured to be positioned underneath, and not to protrude beyond a depth of, the motor when the movable partition is retracted.

10. An automatic drive system for a movable partition, comprising:

a floating jamb configured to attach to panels of a movable partition and to glide within a pocket;

a motor configured, when operably coupled to the movable partition, to extend the movable partition, the motor being configured for mounting in the pocket on a back side of the floating jamb opposing a front side of the floating jamb to which the panels of the movable partition are configured to attach; and an electronics enclosure configured to contain electronics to connect to the motor, the electronics enclosure being sized and configured for positioning in the pocket on the back side of the floating jamb in a location offset from a location where the motor is configured to be positioned, wherein a depth of the electronics enclosure, as measured in a direction in which the floating jamb is mounted to glide, is less than or equal to a depth of the motor;

wherein the electronics enclosure comprises wheels on a bottom of the electronics enclosure configured to roll freely in the pocket.

11. A movable partition system, comprising:

a movable partition comprising a sheet of interconnected panels configured to extend for subdividing a space and to retract for storing in a pocket;

a floating jamb attached to the sheet of interconnected panels, the floating jamb being mounted to glide within the pocket responsive to extension and retraction of the movable partition;

a motor configured and operably coupled to extend the movable partition, the motor being mounted in the pocket on a back side of the floating jamb opposing a front side of the floating jamb on which the sheet of interconnected panels is positioned;

an electronics enclosure sized and configured to contain electronics to connect to the motor, the electronics enclosure being configured for positioning in the pocket on the back side of the floating jamb in a location offset from a location where the motor is configured to be positioned, wherein a depth of the electronics enclosure, as measured in a direction in which the floating jamb is mounted to glide, is less than or equal to a depth of the motor, as measured in the same direction; and electronics housed in the electronics enclosure, the electronics selected from the group consisting of a power converter, a battery, a motor controller unit, a voltage calibrator, a switch, a circuit breaker, and a fuse;

wherein the motor is connected to the electronics by wiring extending from the motor, past the floating jamb to the front side thereof, back through an opening in the floating jamb to the back side, to the electronics.

12. A method of installing an automatic drive system for a movable partition, comprising:

supporting a movable partition comprising a sheet of interconnected panels;

positioning a floating jamb within a pocket configured to store at least a portion of the movable partition when in a retracted state and attaching the floating jamb to the sheet of interconnected panels;

mounting a motor configured to extend the movable partition to an extended state in the pocket on a back side of the floating jamb opposing a front side of the floating jamb on which the sheet of interconnected panels is located within the pocket;

positioning an electronics enclosure sized and configured to contain electronics to connect to the motor in the pocket offset from the motor, wherein a depth of the electronics enclosure, as measured in a direction in which the floating jamb is mounted to glide, is less than or equal to a depth of the motor, as measured in the same direction;

housing electronics in the electronics enclosure, the electronics being selected from the group consisting of a power converter, a battery, and a motor controller unit; and connecting the motor to the electronics by extending wiring from the motor, past the floating jamb to the front side, back through an opening in the floating jamb to the back side, to the electronics.

13. The method of claim 12, further comprising attaching the electronics enclosure to or integrating the electronics enclosure with the back side of the floating jamb.

14. The method of claim 12, further comprising retracting the movable partition into the retracted state and abutting the floating jamb against the motor.

15. The method of claim 12, further comprising positioning the electronics enclosure underneath the motor when the movable partition is in the retracted state such that the electronics enclosure does not protrude beyond a depth of the motor.

16. The method of claim 12, further comprising selecting a length of the wiring to enable the electronics enclosure to be moved out of the pocket without disconnecting the wiring.

17. The method of claim 12, wherein the electronics enclosure comprises an access panel, and further comprising opening the access panel to access the electronics.

18. A method of installing an automatic drive system for a movable partition, comprising:

supporting a movable partition comprising a sheet of interconnected panels;

positioning a floating jamb within a pocket configured to store at least a portion of the movable partition when in a retracted state and attaching the floating jamb to the sheet of interconnected panels;

mounting a motor configured to extend the movable partition to an extended state in the pocket on a back side of the floating jamb opposing a front side of the floating jamb on which the sheet of interconnected panels is located within the pocket;

positioning an electronics enclosure sized and configured to contain electronics to connect to the motor in the pocket offset from the motor, wherein a depth of the electronics enclosure, as measured in a direction in which the floating jamb is mounted to glide, is less than or equal to a depth of the motor; and supporting the electronics enclosure on rollers configured to roll freely on a horizontal surface in the pocket.

* * * * *